US009409222B2

(12) United States Patent
Moore et al.

(10) Patent No.: US 9,409,222 B2
(45) Date of Patent: Aug. 9, 2016

(54) REDUCING WASTE IN METAL STAMPING PROCESSES AND SYSTEMS THEREFOR

(75) Inventors: William R. Moore, Barrie (CA); Kevin P. Glenn, Stayner (CA)

(73) Assignee: HONDA MOTOR CO., LTD., Tokyo (JP)

( * ) Notice: Subject to any disclaimer, the term of this patent is extended or adjusted under 35 U.S.C. 154(b) by 523 days.

(21) Appl. No.: 13/581,662

(22) PCT Filed: Feb. 25, 2011

(86) PCT No.: PCT/CA2011/000209

§ 371 (c)(1),
(2), (4) Date: Aug. 29, 2012

(87) PCT Pub. No.: WO2011/106869

PCT Pub. Date: Sep. 9, 2011

(65) Prior Publication Data

US 2012/0318034 A1 Dec. 20, 2012

(30) Foreign Application Priority Data

Mar. 1, 2010 (CA) ..... 2695101

(51) Int. Cl.
*B21D 22/06* (2006.01)
*B21D 22/22* (2006.01)
*B21D 24/04* (2006.01)

(52) U.S. Cl.
CPC ..... *B21D 22/06* (2013.01); *B21D 22/22* (2013.01); *B21D 24/04* (2013.01)

(58) Field of Classification Search
CPC ..... B21D 22/02; B21D 22/22; B21D 24/00; B21D 24/06; B21D 24/08; B21D 24/16; B21D 28/04; B21D 28/06; B21D 28/14; B21D 37/10; B21D 43/00; B21D 43/003; B21D 43/023; B23Q 3/183
USPC ..... 72/334, 337, 338, 348, 296, 347, 350, 72/379.2
See application file for complete search history.

(56) References Cited

U.S. PATENT DOCUMENTS 3,968,673 A * 7/1976 Ryan et al. ..... 72/331
4,195,510 A 4/1980 Juergens (Continued)

FOREIGN PATENT DOCUMENTS

JP 63-313618 A 12/1988
JP 2003-053445 A 2/2003
WO WO 2009124860 A1 * 10/2009

*Primary Examiner* — Shelley Self
*Assistant Examiner* — Peter Iannuzzi
(74) *Attorney, Agent, or Firm* — Standley Law Group LLP

(57) ABSTRACT

Disclosed herein is a sheet metal stamping device and methods for reducing the size of a blank required for producing a stamped part therefrom than is conventionally possible. The device utilizes an intermediate clamp section with projections having clamping formations located thereon which complement clamping formations located on a first die section. The intermediate clamp section projections allow for the use of a smaller blank size as less addendum material is required to secure the blank during the stamping process. The blank is secured using the intermediate clamp section and the first die section prior to the second die section engaging the blank to stamp the part. In some embodiments, retention beads resultant from the clamping process may remain in the stamped part, that being inside a trim line. Furthermore, in some embodiments, a blank shifter may be provided to locate the blank between the die sections prior to clamping. In other embodiments, more than one complementary pair of clamping formations may be provided. Furthermore, in some embodiments a trim line cutter may be provided.

18 Claims, 19 Drawing Sheets

(56) References Cited

U.S. PATENT DOCUMENTS

| | | | | |
|---|---|---|---|---|
| 4,254,650 | A | 3/1981 | Ash | |
| 5,507,189 | A | 4/1996 | Kim | |
| 5,604,044 | A | 2/1997 | McCabe | |
| 5,644,943 | A | 7/1997 | Lanz | |
| 6,006,564 | A | 12/1999 | Frisby | |
| 6,032,504 | A | 3/2000 | Onat | |
| 6,196,043 | B1 | 3/2001 | Ehardt | |
| 6,276,185 | B1 | 8/2001 | Owens | |
| 6,276,285 | B1 | 8/2001 | Ruch | |
| 6,837,087 | B2 | 1/2005 | Kleber | |
| 7,237,423 | B1 | 7/2007 | Nagel | |
| 8,522,593 | B2 | 9/2013 | Flehmig et al. | |
| 2004/0148997 | A1 | 8/2004 | Amino et al. | |
| 2006/0137422 | A1 | 6/2006 | Kodaka | |
| 2008/0209974 | A1 | 9/2008 | Ewolski | |
| 2009/0044592 | A1* | 2/2009 | Shikano et al. | 72/382 |
| 2010/0018280 | A1* | 1/2010 | Maeda | B21D 22/02 72/358 |
| 2010/0101298 | A1* | 4/2010 | Carstensen | 72/420 |
| 2011/0094283 | A1* | 4/2011 | Flehmig et al. | 72/347 |

* cited by examiner

REDUCING WASTE IN METAL STAMPING PROCESSES AND SYSTEMS THEREFOR

FIELD

The present disclosure relates to devices and methods for reducing waste in metal stamping lines.

BACKGROUND

The cost of materials in the metal industry, such as flat rolled steel, has been increasing, rapidly given the world supply and demand as well as increasing energy costs required to produce various metal products. Between 2003 and 2009 the average steel price has increased by about three times and is projected to increase about an additional 15% by 2011; far exceeding the anticipated rate of inflation.

When sheet metal blanks are used to produce stamped metal parts, excess material is required about the perimeter of the blank. This excess material is known as the addendum and is used as a region for clamping and maintaining the blank in place during the stamping process. Ultimately the addendum is removed from the final part and scrapped.

Since the addendum is not integral to the final part resulting from the stamping process and is ultimately removed as scrap, it would be desirable to develop a device and method for holding a blank in place during the stamping process which requires a smaller amount of addendum material. Additionally, it would be desirable to develop a device and method where the portion of the blank which is used to hold the blank in place during the stamping process remains in the final part. A smaller amount of addendum material would result in lower material input cost and less scrap resulting from the stamping process. For example, in the automotive industry, reducing size of the blank addendum required to form the final part by merely 10% may result a material cost savings of millions of dollars per year.

SUMMARY OF THE GENERAL INVENTIVE CONCEPT

The following presents a simplified summary of the general inventive concept herein to provide a basic understanding of some aspects of the invention. This summary is not an extensive overview of the invention. It is not intended to restrict key or critical elements of the invention or to delineate the scope of the invention beyond that explicitly or implicitly described by the following description and claims.

In an exemplary embodiment, there is provided a stamping device for stamping a metal blank, comprising a first die section and a second die section. The first and second die sections include complementary first and second surface portions with respective first and second work piece-forming regions located thereon where each of the first and second surface portions have substantially coextensive boundary portions. The first and second die sections are operable for movement along a travel path relative each other between a retracted position and a stamping position where, when in the stamping position, the first and second surface portions are in communication. The first and second work piece-forming regions are arranged for shaping a work piece from a metal blank within the boundary portions when the die sections are in the stamping position. An intermediate clamp section located intermediate the first and second die sections for engaging the first die section at a clamping position is provided. The first die section and the intermediate clamp section include respective first and second clamping formations for clamping the blank. The intermediate clamp section includes a peripheral region with a plurality of projections extending inwardly therefrom and the second die section has cut-out regions for receiving a corresponding projection. The first die section is movable relative to the second die section from the retracted position to the clamping position before reaching the stamping position so as to clamp the blank between the first die section and the intermediate clamp section. The intermediate clamp section is operable for travel with the first die section relative to the second die section, to the stamping position so as to nest with the second die section with the projections resident in the corresponding cut-out regions.

In some exemplary embodiments, the second surface portion has at least one support portion, slidably extending therethrough, for supporting the blank prior to clamping. Furthermore, in various exemplary embodiments, the supporting portion is movable relative the second die section wherein the second die section is operable for travel to the stamping position so as to disengage the blank and the supporting portion.

In some exemplary embodiments, the projections are oriented so as not to interrupt the second work piece-forming region. In other exemplary embodiments, the projections may be oriented so as to interrupt the second work piece-forming region.

In some exemplary embodiments, the clamping formations are shaped to form retention beads on a peripheral scrap region in the blank which is spaced from the work piece. In other exemplary embodiments the clamping formations may be continuous with the piece-forming regions.

In some exemplary embodiments, the first die section and the intermediate clamp section further comprise at least respective third and fourth clamping formations for clamping various sizes of blanks.

In some exemplary embodiments, the intermediate clamp section includes a trim line cutter.

In some exemplary embodiments, the intermediate clamp section further comprises a blank shifting member operable for aligning the blank for clamping with first and second clamping formations and/or the third and fourth clamping formations. In various exemplary embodiments, the blank shifting member is an actuated member suitable for aligning and maintaining the blank in a desired clamping position. Furthermore, in various exemplary embodiments, the actuated member is a hydraulic cylinder with a piston carrying an effector operatively coupled to the intermediate clamp section such that the piston may align and maintain the blank in the desired clamping position.

In another exemplary embodiment, there is provided a method for reducing the required length of a blank to produce a stamped part therefrom. The method comprises the steps of:

a) placing the blank between a first die section and second die section with the die sections in a retracted position;
   - the first and second die sections being operable for movement along a travel path relative each other between the retracted position and a stamping position;
   - the first and second die sections including complementary first and second surface portions with respective first and second work piece-forming regions located thereon;
   - the first and second work piece-forming regions being arranged for shaping a work piece from a metal blank within boundary portions in the stamping position;
   - an intermediate clamp section located intermediate the first and second die sections for engaging the first die section at a clamping position;

the intermediate clamp section including a peripheral region with a plurality of projections extending inwardly therefrom and the second die section having cut-out regions, each cut-out region for receiving a corresponding projection;

the first die section and the intermediate clamp section including respective first and second clamping formations for clamping the blank;

b) aligning the blank with the clamping formations;

c) causing the first die section to travel relative to the intermediate clamp section to engage the blank therebetween for clamping the blank therebetween;

d) causing the first die section and the intermediate clamp section to travel relative to the second die section with each projection being received in a corresponding cut-out region on the second work piece-forming region so as to communicate with the first work-piece forming region in a stamping position so as to form a stamped part; and f) removing the stamped part from between the die sections.

Some exemplary embodiments further comprise utilizing respective third and fourth clamping formations on the first die section and the intermediate clamp section at least for clamping blanks of different sizes.

Still some exemplary embodiments further comprise utilizing a blank shifter for aligning the blank in step (b) for clamping with the first and second clamping formation and/or the third or fourth clamping formations.

In some exemplary embodiments, the blank is of a first length for clamping with the first and second clamping formations and/or the third and fourth clamping formations, or of a second length for clamping with the third and fourth clamping formations.

In some exemplary embodiments, the method may further comprise cutting the stamped part along a trim line so as to sever a peripheral scrap region from the final part

BRIEF DESCRIPTION OF THE DRAWINGS

Several exemplary embodiments will be provided, by way of examples only, with reference to the appended drawings, wherein.

DESCRIPTION OF THE EXEMPLARY EMBODIMENTS

Figure 1A:
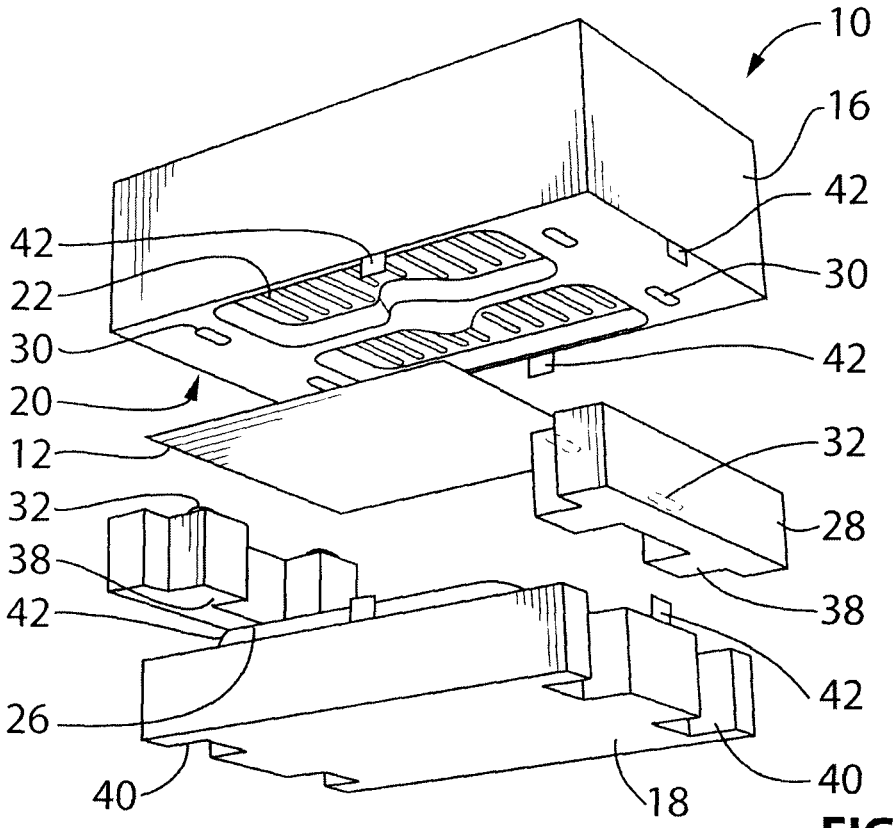
FIG. 1*a* is a perspective view of a stamping device embodiment for reducing the amount of addendum material.

It should be understood that the present disclosure is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical, other configurations illustrated in the drawings are intended to show exemplary embodiments. However, other alternative mechanical or other configurations are possible which are considered to be within the teachings of the instant disclosure.

With reference to the figures, there is provided a stamping device 10 for stamping a metal blank 12 to produce a stamped part 14. The device 10 as described herein may allow the use of a smaller blank 12 as compared to conventional stamping devices. The device 10 comprises a first die section 16 and a second die section 18. The first die section 16 includes a first surface portion 20 having a first work piece-forming region 22. The second die section 18 includes a second surface portion 24 and a second work piece-forming region 26. The first surface portion 20 and the second surface portion 24 as well as the first work piece-forming region 22 and the second work piece-forming region 26 are respectively substantially complementary. Located between the first 16 and second 18 die sections is an intermediate clamp section 28 comprising clamp modules 29 (see FIG. 2*a*) for engaging with the first die section 16 at a clamping position as shown in FIGS. 2*a*, 2*b*, 3*a* and 3*b*.

The die sections 16 and 18 have boundary portions 42 located near the respective perimeters for aligning a blank 12 between the die sections 16 and 18. The boundary portions 42 are substantially co-extensive.

Figure 1B:
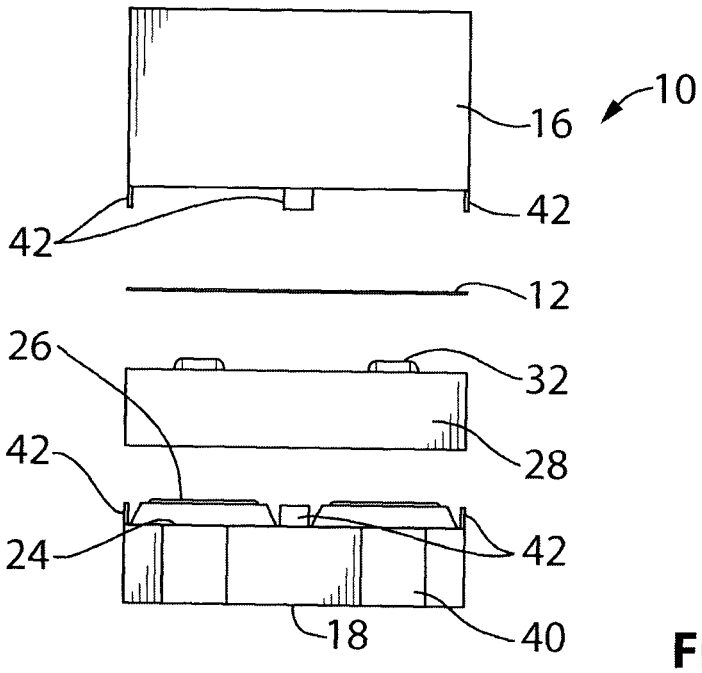
FIG. 1*b* is an end view on an embodiment of FIG. 1*a;*
Figure 2A:
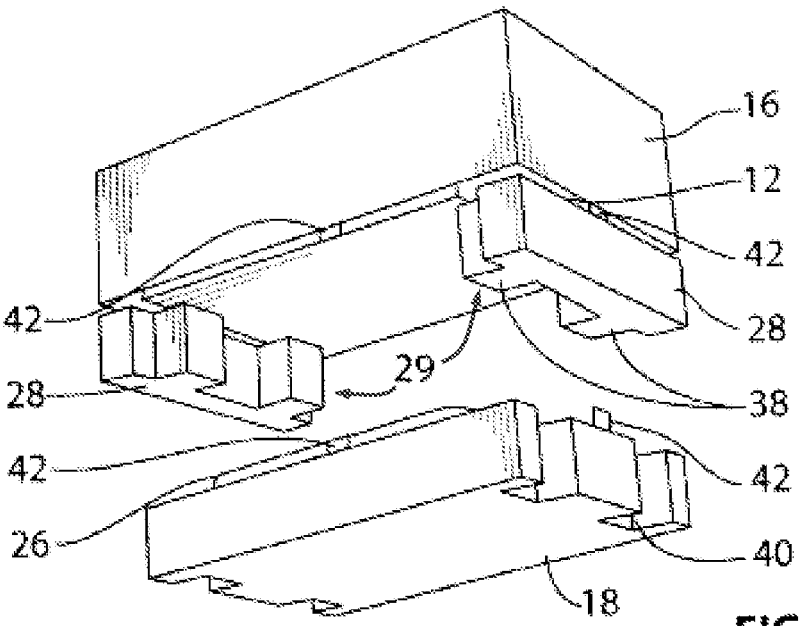
FIG. 2*a* is an operational perspective view of an embodiment of the device of FIG. 1*a* in a clamping position.
Figure 2B:
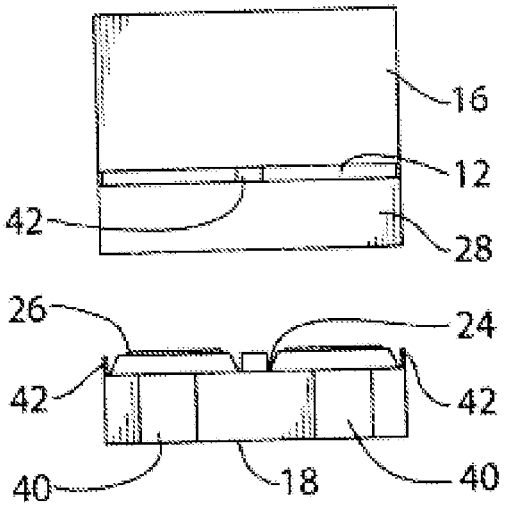
FIG. 2*b* is an end view of FIG. 2*a;*
Figure 2C:
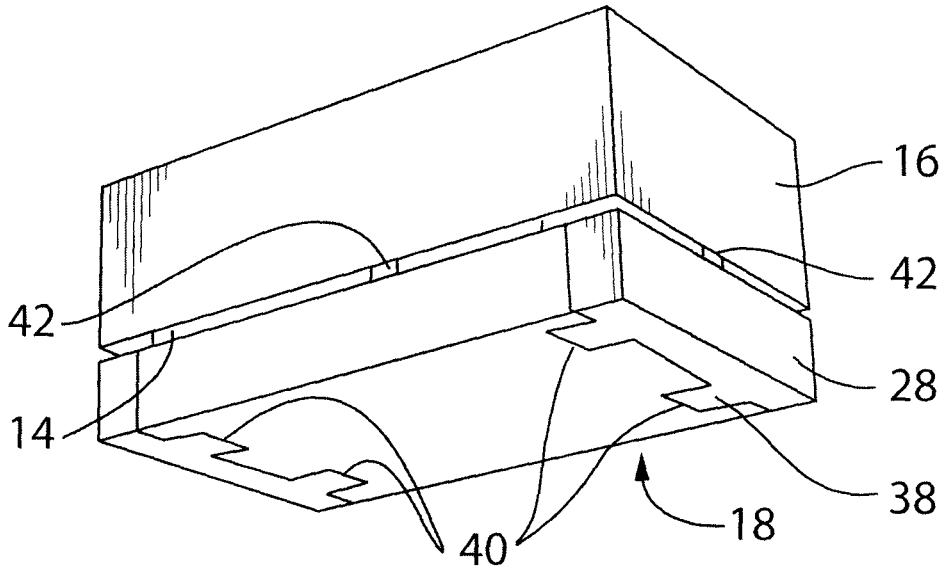
FIG. 2*c* is an operational perspective view of an embodiments of FIG. 2*a* in a stamping position.
Figure 2D:
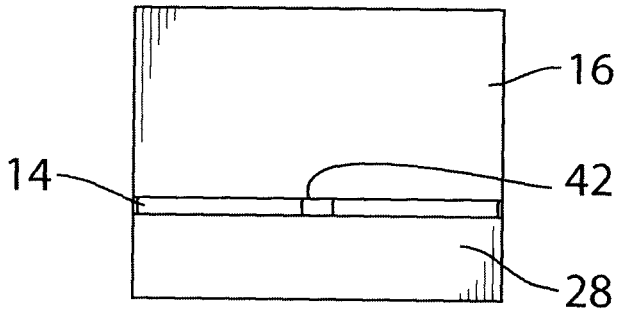
FIG. 2*d* is an end view of FIG. 2*c;*
Figure 2E:
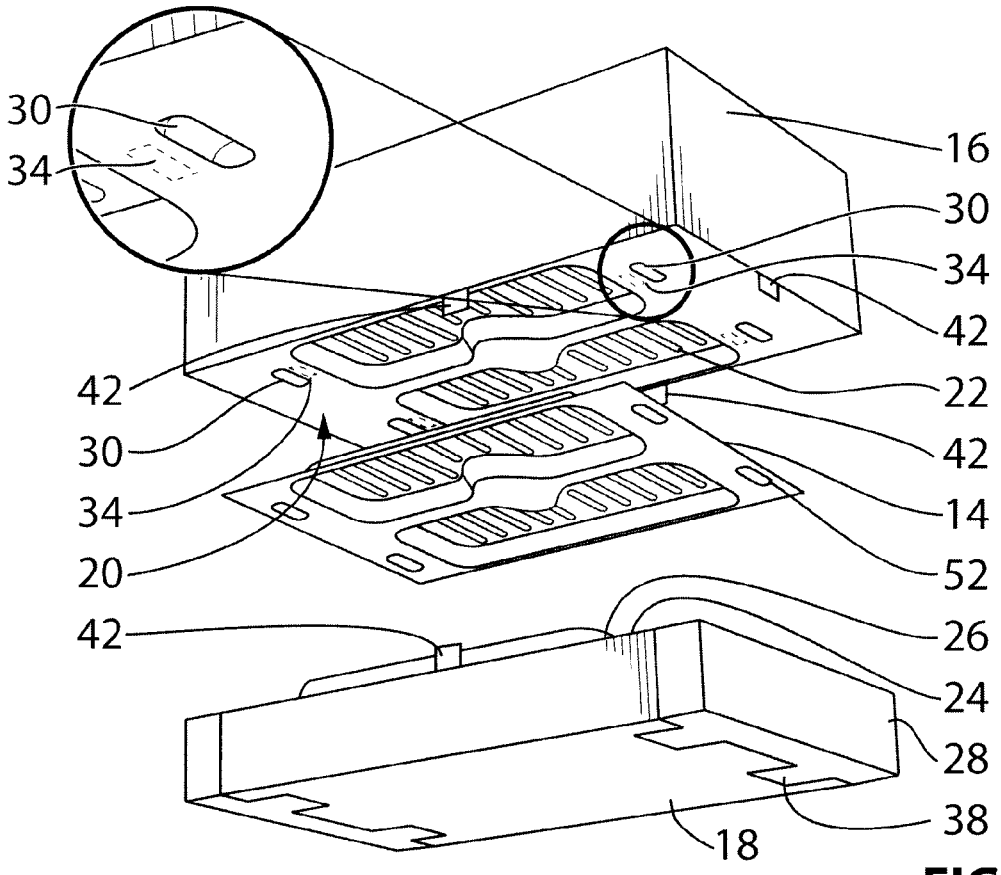
FIG. 2*e* is an operational perspective view of an embodiment of the device of FIG. 2*a* following a stamping action.
Figure 3F:
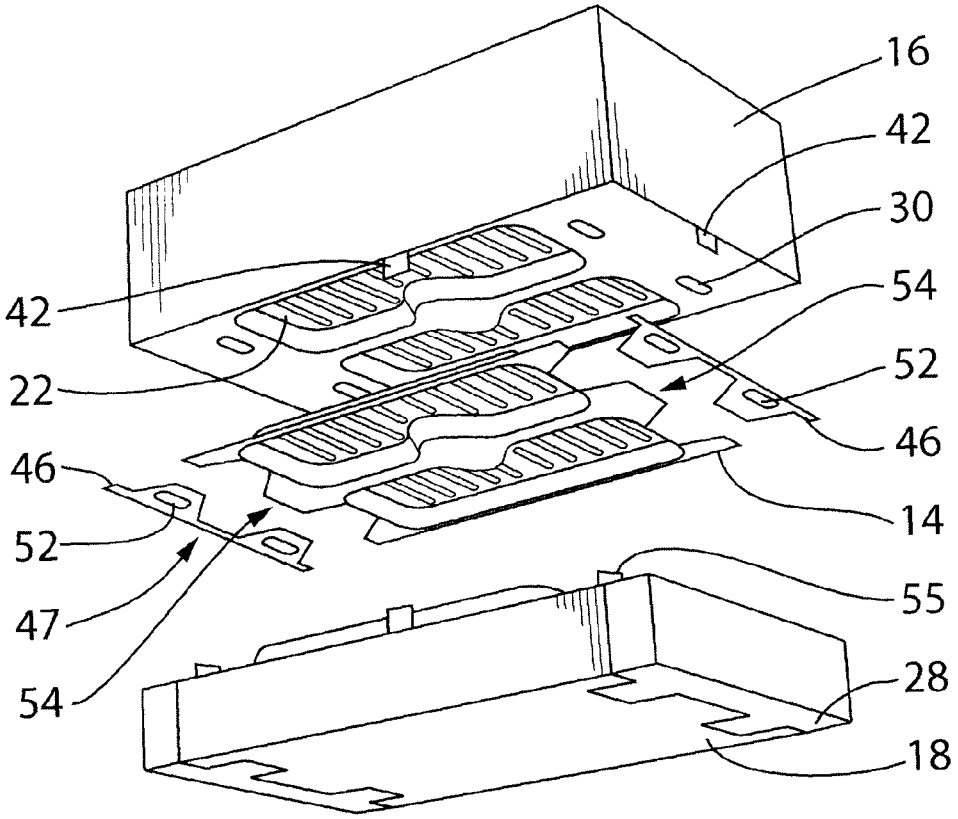
FIG. 3*f* is an operation perspective view of an embodiment of the device of FIG. 3*a* following a stamping action.
Figure 4A:
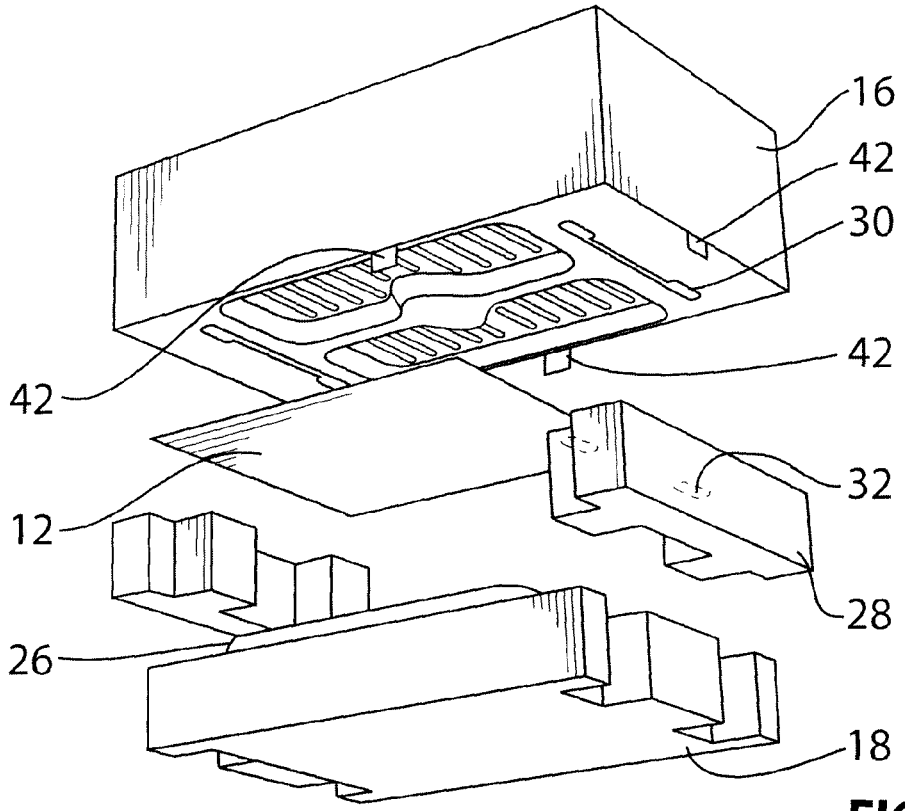
FIG. 4*a* is a perspective view of an embodiment of the device of FIG. 1.
Figure 4B:
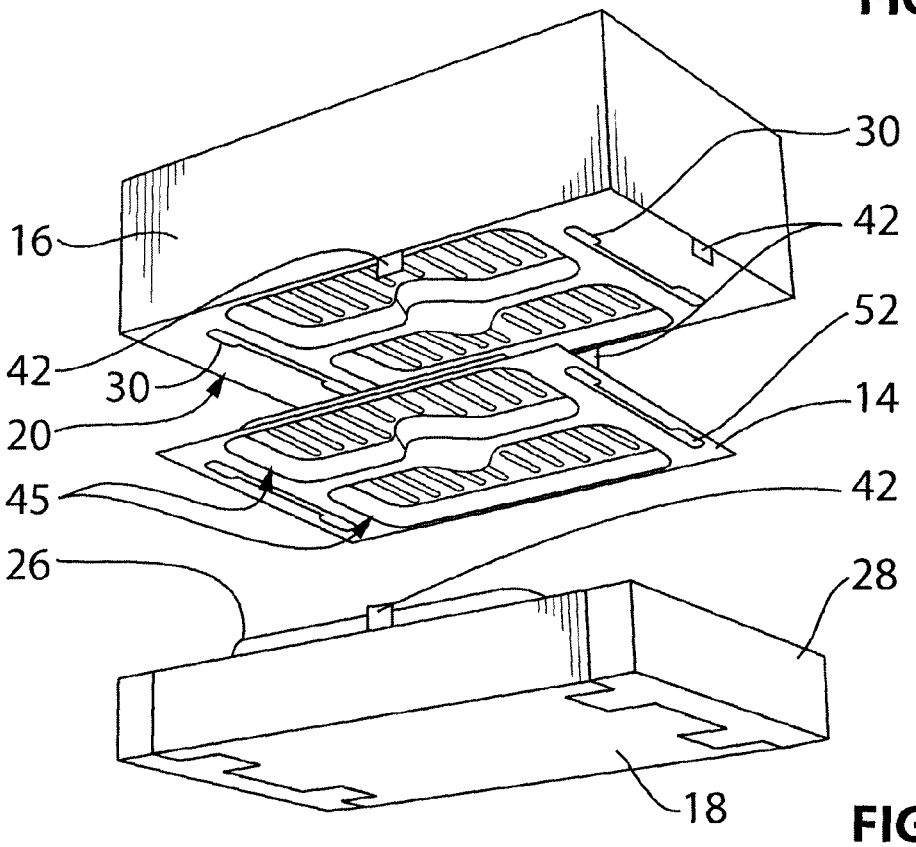
FIG. 4*b* is a perspective view of the device of FIG. 4*a* with the die sections in a retracted position and a stamped part therebetween.

With reference to FIGS. 1*a* and 1*b*, the first die section 16 includes one or more first clamping formations 30, each of which is substantially complementary with a second clamping formation 32 located on the intermediate clamp section 28. In various other exemplary embodiments, the first die section 16 and the intermediate clamp section 28 may comprise additional or secondary complementary clamping formations for accommodating blanks 12 of various sizes to be stamped in the device 10. For example, as seen in FIG. 6*b*, the additional clamping formations may include one or more fourth clamping formations 36 located on the intermediate clamp section 28, and one or more third clamping formations 34 located on the first die section 16, as shown in FIG. 2*e*. Additionally, the shape of the clamping formations 30 and 32, and in some exemplary embodiments the third and fourth formations 34 and 36, may vary depending on the desired contour of the stamped part 14. For example, as shown in FIGS. 4*a* and 4*b*, the first clamping formation 30 may be provided as an elongate depression with the second clamping formation 32 being provided as a protrusion (not shown) complementary to the first clamping formation 30. Accordingly, an elongate retention bead 52 is formed in the stamped part 14 as shown in FIG. 4*b*. In this case, the retention bead 52 is shown as a discrete formation a distance from the two elongate floor panel stamped sections 45. The retention bead 52 may, alternatively be structurally continuous with the other non-planar structures of the stamped part 14, for example the two elongate floor panel sections 45 (not shown). The retention bead or beads 52 may be included in the stamped part 14 or removed as a peripheral scrap region 47 in the addendum material 46 as shown, for example, in the exemplary embodiment in FIG. 3*f*.

As shown in the figures and with particular reference to FIG. 1*a*, the intermediate clamp section 28 includes projections 38 which extend inwardly and are respectively received in cut-out regions 40 located in the second die section 18. The clamping formations 32 are thus located on the projections 38 of the intermediate clamp formation 28. In a clamping position, as shown for example, in FIGS. 2*a*, 2*b*, the clamping formations 30 and 32 (not visible in the figure view) mate with the blank 12 therebetween so as to hold the blank 12 in place during the stamping process. The secondary clamping formations 34 and 36, in various other embodiments may function similarly to enhance the clamping of a blank 12 in place during the stamping process, or to allow for clamping a blank of a different size.

Figure 2F:
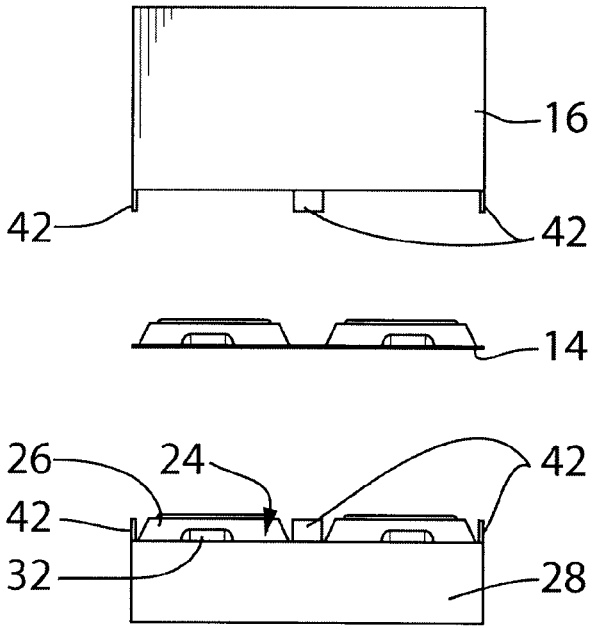
FIG. 2*f* is a an end view of FIG. 2*e;*
Figure 9:
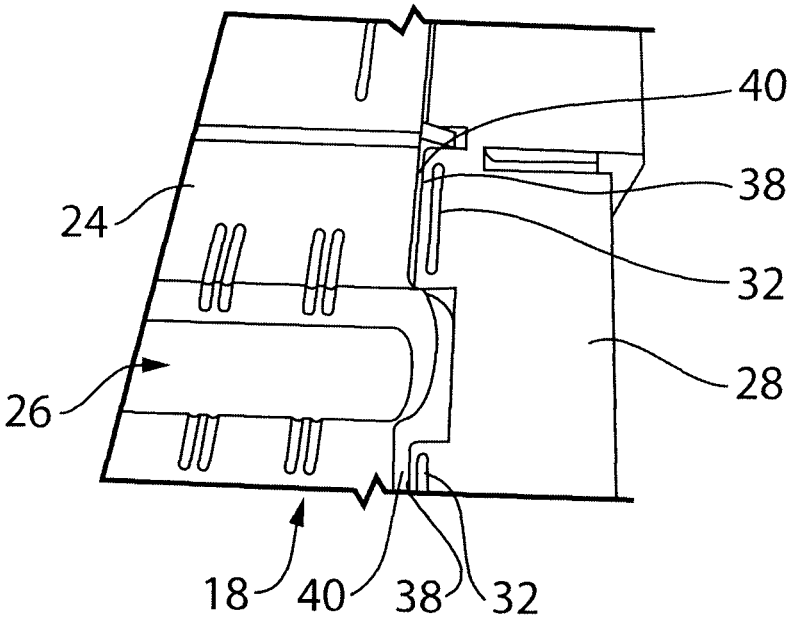
FIG. 9 is a fragmented perspective view of an embodiment of a second die section and an intermediate clamp section with the projections nested in the cut-out regions.

In operation, the first die section 16 or the second die section 18, or both, are operable for movement along a travel path relative to each other between a retracted position and a stamping position. As noted above, the intermediate clamp section 28 is located between the first and second die sections 16 and 18 when the die sections are in a retracted position as shown in FIG. 1*a*. The first die section 16 and the intermediate clamp section 28 are movable relative each other from the retracted position to the clamping position as shown in FIGS. 2*a*, 2*b*, so as to clamp the blank 12 between the first die section 16 and the intermediate clamp section 28. The first die section 16 and the intermediate clamp section 28 are operable for travel together relative the second die section 18, such that the stamped part 14 is formed by the mating of the first work piece-forming region 22 and the second work piece-forming region 26 with the die sections 16 and 18 in the stamping position and the blank 12 maintained in position therebetween, as shown in FIGS. 2*c*, 2*d*. In this case, the projections 38 nest with the corresponding cut-out regions 40. FIGS. 2*e*, 2*f* show an exemplary resultant stamped part 14 following the stamping operation with the intermediate clamp section 28 and the first 16 and second 18 die sections in a retracted position. FIG. 9 shows an embodiment of the second surface portion 24 and the second work piece-forming region 26 with the projections 38 nested in the cut-out regions 40. The second clamping formations 32 are noted on the projections 38. As shown in FIGS. 2*e* and 2*f*, once the stamped part 14 is formed, the die sections 16 and 18 separate and the now formed stamped part 14 is released from the clamping formations 30 and 32.

With reference to FIGS. 1*a* and 1*b*, in operation of the device 10, a blank 12 is placed between the first and second die sections 16 and 18 in a retracted position and confined by the boundary portions 42 to align the blank 12 in place. The first die section 16 and the intermediate clamping section 28 are moved toward each other as shown in FIGS. 2*a*, 2*b*, such that this blank is clamped between the first die section 16 and the intermediate clamp section 28. The first clamp formation 30 and the second clamp formation 32 communicate to maintain the blank 12 in the desired position in the clamping position. The first and second die sections 16 and 18 are then moved towards each other such that the first work piece-forming region 22 and the second work piece-forming region 26 communicate in a stamping position, as shown in FIGS. 2*c*, 2*d*, 3*c*, 3*d* and 3*e*. In the stamping position, the stamped part 14 is formed by the interaction of the work piece-forming regions 22 and 24 with the blank 12 clamped by the clamping formations 30 and 32. As shown in FIG. 2*c*, the projections 38 nest within the cut-out regions 40 of the second die section 18. FIGS. 2*e*, 2*f* show the first and second die sections 16 and 18 in a retracted position with the projections 38 resident in the cut-out regions 40 so as to release the stamped part 14 from the device 10.

Figure 6A:
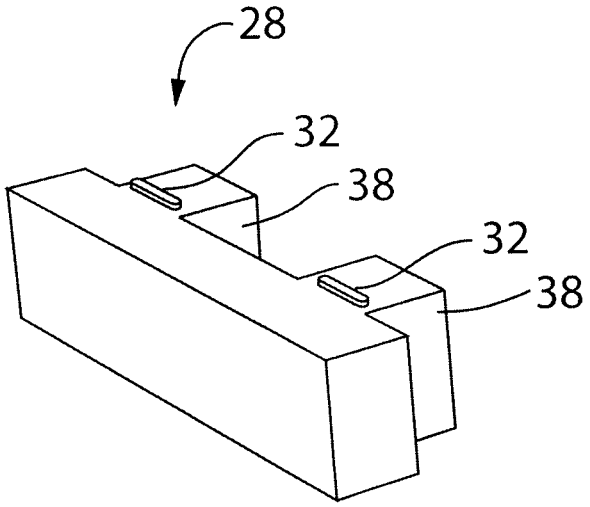
FIGS. 6*a* and 6*b* are perspective views of embodiments the intermediate clamp section and various clamping formations.
Figure 6B:
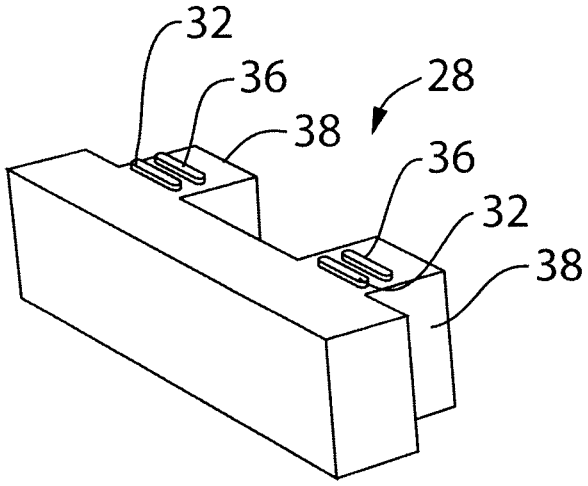

By placing the second clamping formations 32 on the projections 38 as shown specifically in FIG. 6*a*, a smaller blank 12 may be able to be used in the stamping device 10 than as conventionally possible. The placement of the second clamping formations 32 on the projections 38 allows the blank 12 to be clamped between the intermediate clamp section 28 and the first die section 16 prior the first and second work piece-forming regions 22 and 26 engaging the blank 12. By way of example, the blank 12 is then held substantially securely in place such that when the first and second work piece-forming regions 22 and 26 engage the work piece in the stamping position as shown in FIGS. 2*c*, 2*d*, the blank 12 remains in the desired position. Furthermore, the portion of the blank 12 which is grasped by the first and second clamping formations 30 and 32, and thus the formed retention beads 52, may be located within the area occupied by the stamped part 14 following the stamping process.

Figure 3A:
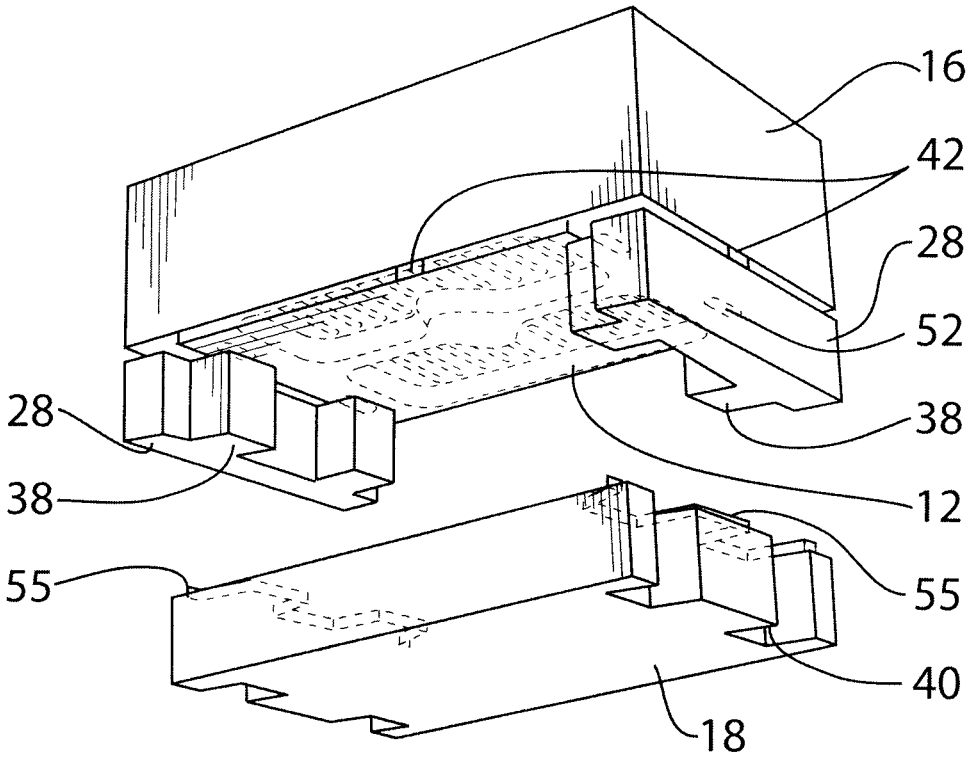
FIG. 3*a* is an operational perspective view of an embodiment of the device of in a clamping position.
Figure 3B:
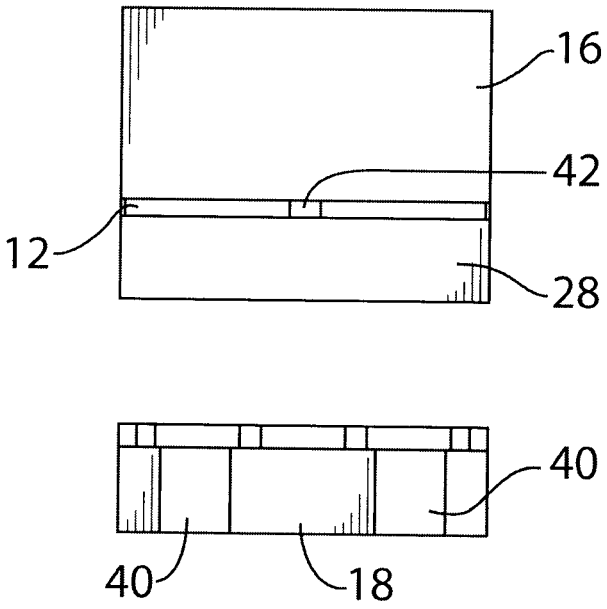
FIG. 3*b* is an end view of FIG. 3*a;*
Figure 3C:
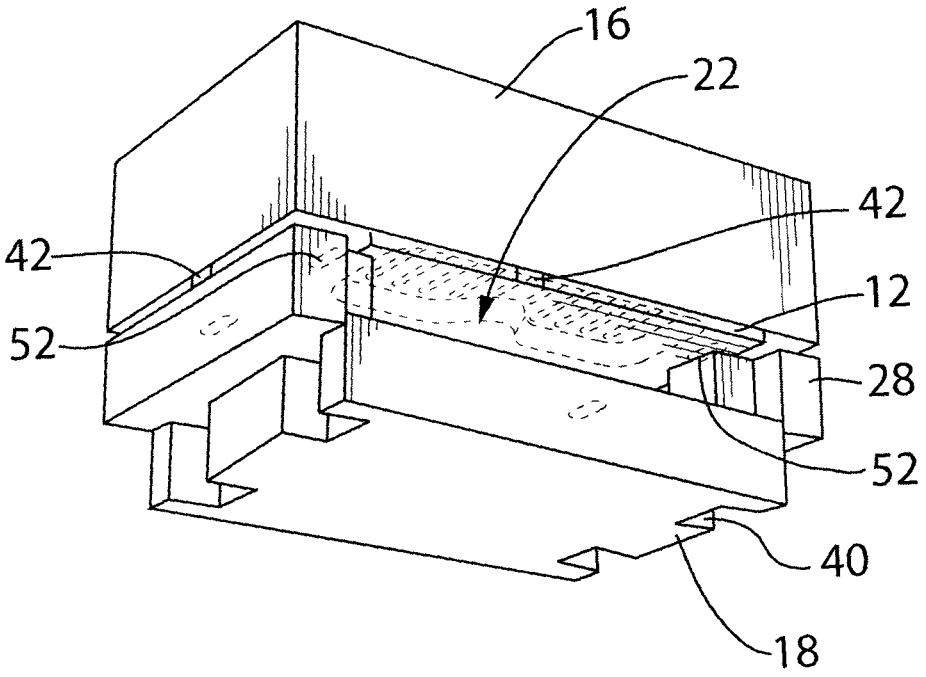
FIG. 3*c* is an operational perspective view of FIG. 3*a* in a clamping position and the second die section moving to a stamping position.
Figure 3D:
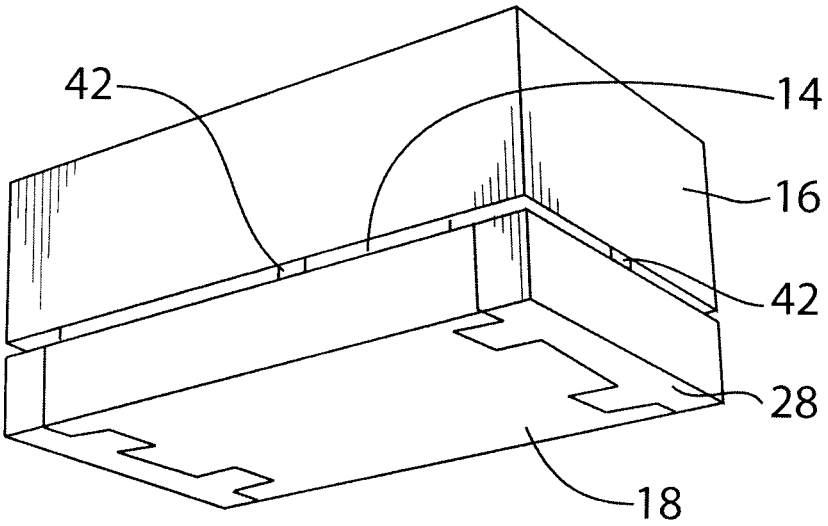
FIG. 3*d* is an operational perspective of an embodiment of FIG. 3*a* in a stamping position.
Figure 3E:
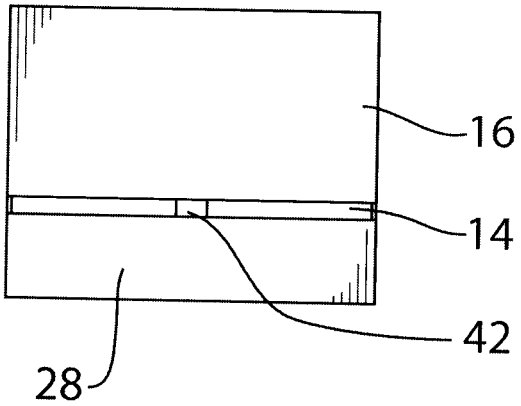
FIG. 3*e* is an end view of FIG. 3*d;*
Figure 3G:
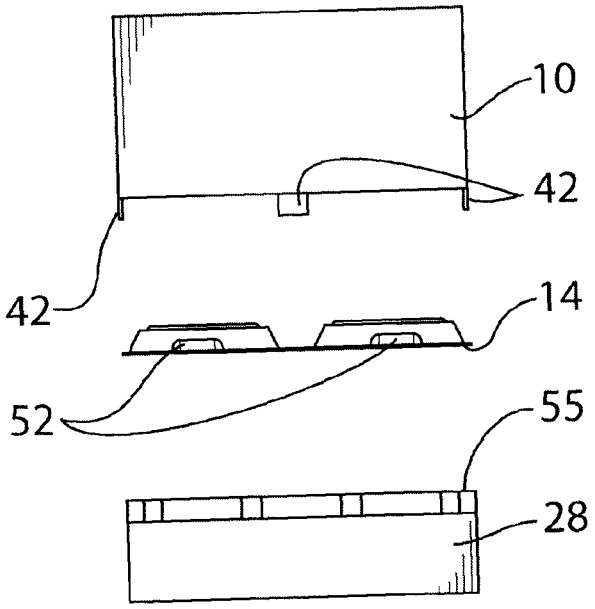
FIG. 3*g* is an end view of FIG. 3*f;*

The clamping formations 30 and 32 thus form a retention bead 52 in the stamped part 14. In some cases, the retention beads 52 may be located inside a trim line 54 and thus remain in the final stamped part 14 as shown in FIGS. 2*e*, 2*f*, 4*b* and 5*c*. In other words, the clamping formations, in this case, can be formed to be continuous with the structural piece-forming regions so as to appear in the finished part. For instance, if the finished part is a floor panel 45, the clamping formations may take the form of reinforcement beads or the like for the finished floor panel 45 In other cases the projections 38, as shown in FIGS. 3*a*, 3*f* and 3*g* may include a trim line cutter 55 to cut along the trim line 54 during the stamping process. In this case, the retention bead 52 may be located in the peripheral scrap region 47 of the addendum 46, outside the trim line 54 as shown in FIG. 3*f*.

Figure 5A:
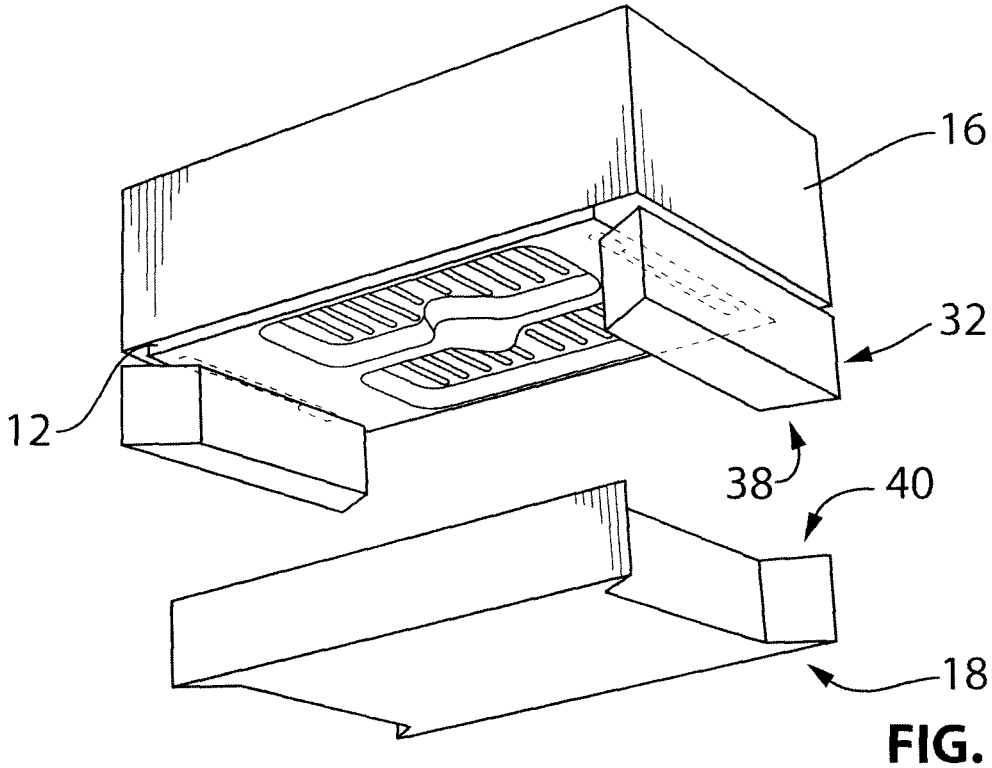
FIG. 5*a* is a perspective of another embodiment of the device.
Figure 5B:
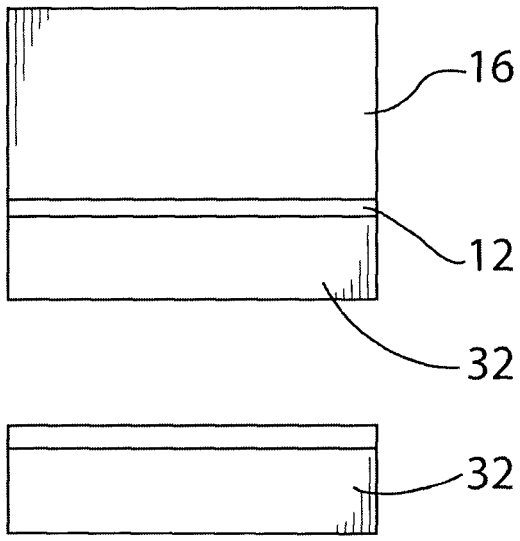
FIG. 5*b* is a end view of FIG. 5*a;*
Figure 5C:
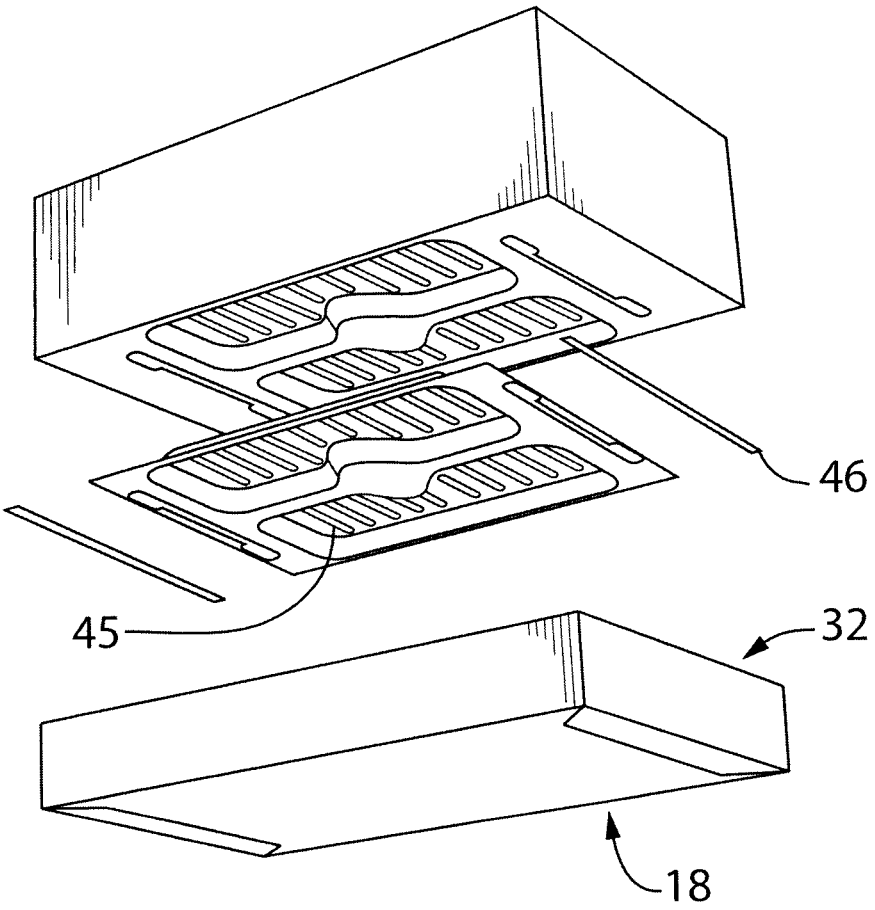
FIG. 5*c* is a perspective view of the device of FIG. 5*a;*

FIGS. 5*a* to 5*c* show a variation of the device in which the intermediate clamp section provides a pair of clamp modules 32 each itself forming a singular projection 38 and dimensioned to fit within a singular cut out region 40 in the section die section 18. FIG. 5*c* in this case also illustrates, schematically, a step of removing the addendum 46, which may occur during the stamping step or in a later step.

Figure 7A:
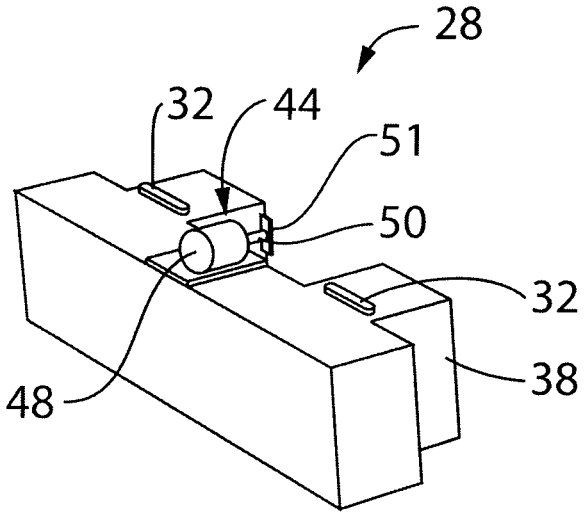
FIG. 7*a* is perspective view of an embodiment of an intermediate clamp section with a blank shifting mechanism coupled thereto.
Figure 7B:
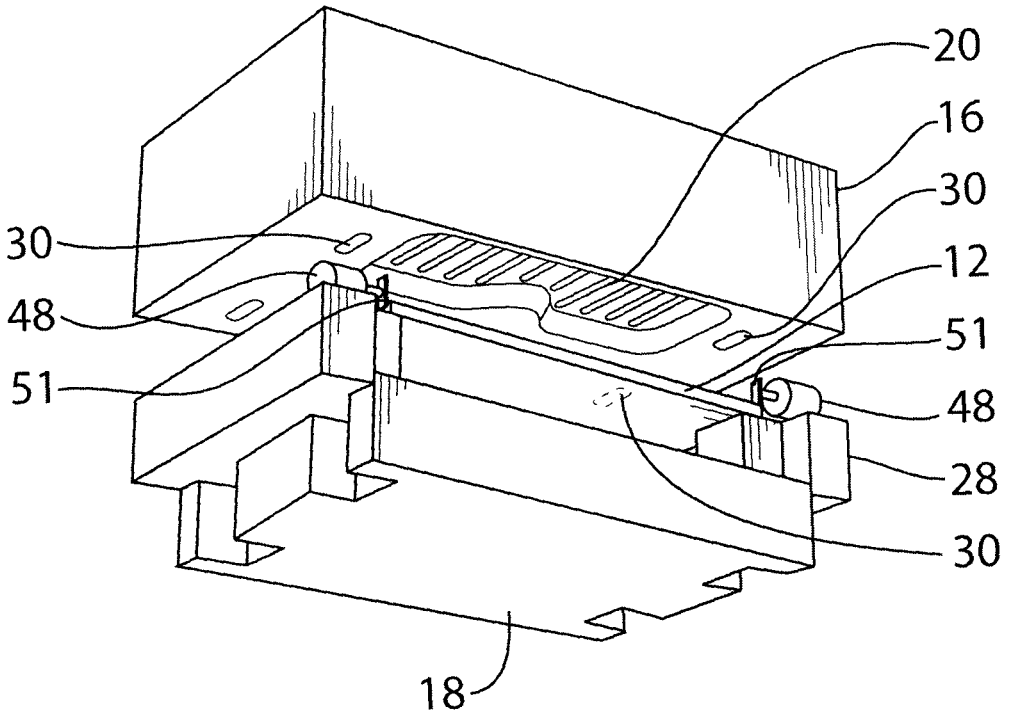
FIG. 7*b* is a perspective view of an embodiment of the device with the blank shifting mechanism interacting with a blank atop the intermediate clamp sections.
Figure 10A:
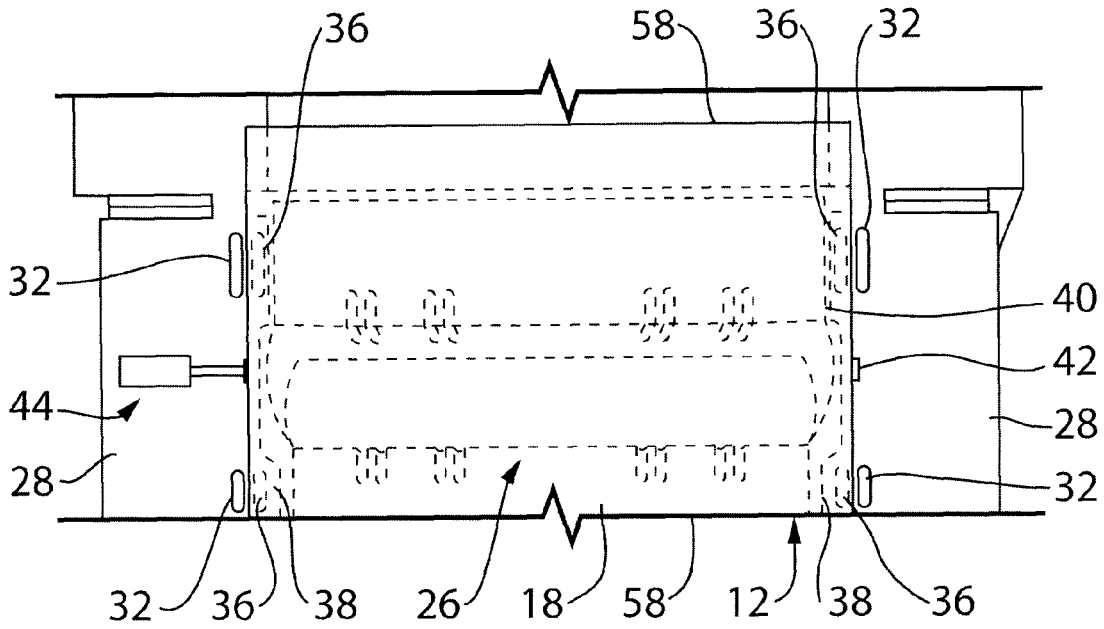
FIG. 10*a* is a fragmented perspective view of another arrangement of an embodiment of a second die section and an intermediate clamp section.
Figure 10B:
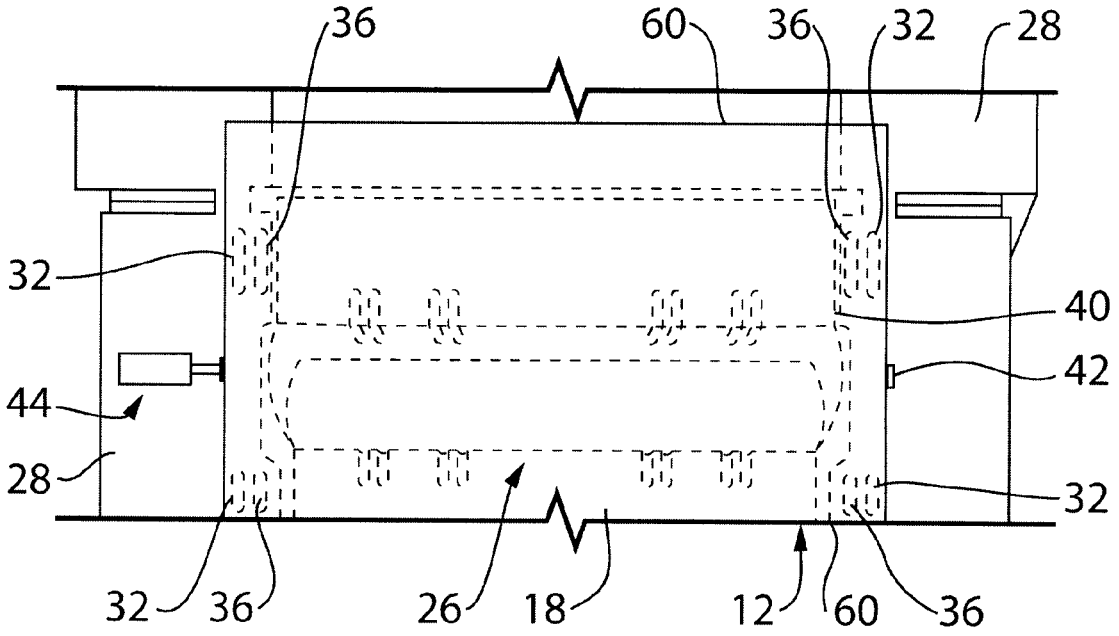
FIG. 10*b* is a fragmented perspective view of a variation of the arrangement shown in FIG. 10*a*.

A blank shifting member 44 may also be provided in various embodiments as shown in FIGS. 7*a* and 7*b*. In this example, the blank shifter 44 is located on the intermediate clamp section 28 and is operable for aligning the blank 12 with the first and second clamping formation 30 and 32 or the third and fourth clamping formations 34 and 36. In various operations, such as producing as floor panel member 45 for an automobile, it may be desirable to employ the same first and second work piece-forming regions 22 and 26 for producing a stamped part 14 for either a 2-door or 4-door automobile. However, the floor panel member 45 may be shorter in overall length in the 2-door version. An exemplary blank 12 having a second length is shown for a 2-door automobile in FIG. 10*a* at 58. In the case of the 2-door exemplary embodiment, the blank shifter 44 may be used to push the blank 12 between the first die section 16 and the second die section 18 in the retracted position to align the blank 12 for clamping using the third and fourth clamping formations 34 and 36 as shown in FIG. 10*a*. The blank 12, in this position is confined by the boundary portions 42. In another exemplary embodiment, such as in the case of a 4-door automobile, a longer blank 12 has a first length as shown in FIG. 10*b* at 60 may be required owing to a longer floor panel section being required. The blank shifter 44 similarly aligns this longer blank 12, for use with the first and second clamping formations 30 and 32. In the case of the use of a longer blank having a first length 60, the third and fourth clamping formations 34 and 36 may also engage the longer blank 60. Thus, the versatility of the device 10, in various embodiments, allows for the use of different sized blanks 12, for example a 2-door automobile-sized blank 58 and as well as a 4-door automobile-sized blank 60 as noted above with the same first and second die sections 16 and 18 thereby reducing the amount of addendum material 46 needed.

In some exemplary embodiments, the blank shifting member 44 is provided atop the intermediate clamp section 28 as shown in FIGS. 7*a* and 7*b*. The blank shifter 44 may be an actuated member, for example a hydraulic cylinder 48 (or solenoid) and operable piston 50, with distal end carrying an end effector 51. The hydraulic cylinder 48 may be coupled to the intermediate clamp section 28 and oriented such the operable piston 50 and effector 51 is able to the push the blank 12 into the desired position with the first and second die sections 16 and 18 in the retracted position as shown in FIG. 7*b*. Various other means of aligning various blank sizes with corresponding clamping formations may also be used.

Figure 8A:
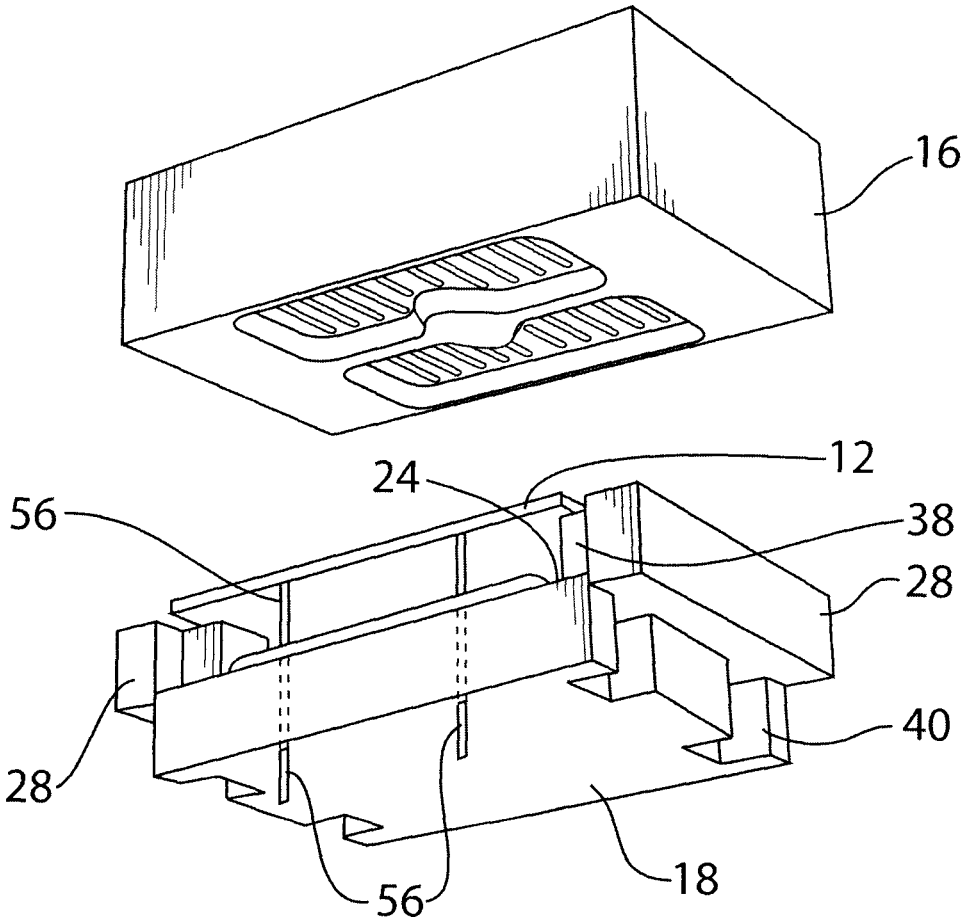
FIG. 8*a* is a perspective view of an embodiment of the device with the support portion supporting a blank and with the die sections in a retracted position.
Figure 8B:
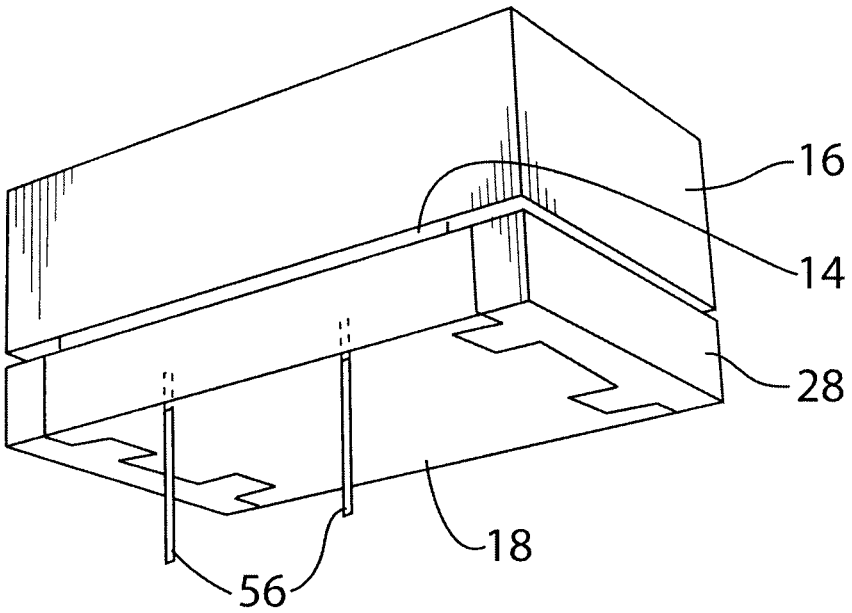
FIG. 8*b* is a perspective of the device of FIG. 8*a* with the support portions receded into the second die section and the first and section die section in a stamping position.

Referring to FIG. 8*a*, at least one support portion 56 may be included in some exemplary embodiments for supporting the blank 12 between the first and second die sections 16 and 18 in the retracted position as shown. Sheet metal blanks 12 are known to be flexible. The size of the addendum 46 is smaller in blanks 12 that may be used with the device 10, as noted above. Due to the flexibility of sheet metal blanks, a smaller blank 12 may be prone to fall to the second surface portion 24 prior to the engagement of the clamping formations 30, 32, 34 and/or 36. Therefore, the support portion or support portions 56 may substantially inhibit the blank 12 from falling into the second surface portion 24. The support portion 56 slidably extends through the second die section 18 and emerges through the second surface portion 24 substantially level with the intermediate clamp section 28, as shown FIG. 8*a*. The support portion 56 is thus able to support the blank 12 when the first and second die sections 16 and 18 are in the retracted position. In operation, as the intermediate clamp section 28 moves relative the first die section 16 to engage the clamping formations and clamp the blank 12 in place for stamping the blank 12, the support portion 56 is no longer required. In other words, once the blank 12 is clamped in the desired position, the blank 12 is supported by the clamping action of the clamping formations 30, 32, 34 and/or 36. The second die section 18 then, as noted above, moves relative the first die section 16 and the intermediate clamp section 28 to the stamping position as shown in FIG. 8*b*. Thus, the support portions 56 may be configured to recede relative the second surface portion 24, so as to not interfere with the stamping process. The stamped part 14 may thus be formed between the first and second work piece-forming, regions 22 and 26.

In some exemplary embodiments the support portion 56 may be provided in the form of a plurality of support pins 56. Additionally, a grouping of support pins 56 may be located in the a peripheral scrap region 47 of the addendum 46 areas such they support the blank 12 in the regions that may not be included in the final stamped part 14.

Thus, in some examples, by combining a blank shifter 44 as shown in FIGS. 7*a* and 7*b*, along with stepped-in draw bead formations 30, 32, 34 and 36 and blank support pins 56, the size of the blank 12 required to produce stamped part 14 therefrom may be reduced. The reduction in the size of the blank 12 required for use in the device 10 may realize material input savings and thus increasing the material yield. By way of providing the stepped draw bead formations 30, 32, 34 and/or 36 to initially clamp a blank 12 in place prior to stamping using an intermediate clamp section 28 in communication with a first die section 16, less addendum 46 material is needed to hold the blank 12 in place during stamping. A similar final part 14 may be produced as using convention stamping devices; however less blank material is required. In some embodiments, the amount of blank material required may be reduced.

Furthermore, in some embodiments, the draw beads 52 may remain in the final part 14 as shown, for example, in FIGS. 2*e*, 2*f*, 3*f*, 3*g*, 4*b* and 5*c*. The lower blank holder 28 and the upper die 16 move relative each other to clamp the blank 12 as shown FIGS. 2*a* and 5*a*. The lower die 18 then engages the blank 12 and the panel 14 is formed around the lower die 18 by complementary work piece-forming regions 22 and 26 as shown in FIGS. 2*c* and 2*d*. The work piece-forming regions 22 and 26 are located on the upper and lower die sections 16 and 18 respectively.

Those of skill in the art will recognize certain modifications, permutations, additions and sub-combinations thereof of parts noted herein. While the stamping device 10 for stamping a sheet metal blank 12 and a method has been described for what are presently considered the exemplary embodiments, the present disclosure is not so limited. To the contrary, the present disclosure is intended to cover various modifications and equivalent arrangements included within the spirit and scope of the appended claims. The scope of the following claims is to be accorded the broadest interpretation so as to encompass all such modifications and equivalent structures and functions.

The invention claimed is:

1. A stamping device for stamping a metal blank, comprising:

a first die section and a second die section, the first and second die sections operable for movement along a travel path relative to each other between a retracted position and a stamping position;

the first and second die sections including complementary first and second surface portions with respective first and second work piece-forming regions located thereon, the first die section including a pair of opposed first die section boundaries and the first work-piece forming region being located in a central inner region of the first die section and spaced from the opposed first die section boundaries;

die sections being configured to receive a metal blank therebetween, the metal blank having opposed edges to be inwardly spaced from the corresponding first die section boundaries, the first and second work-piece forming regions being arranged for shaping a work piece from the metal blank in the stamping position;

an intermediate clamp section located intermediate the first and second die sections;

the first die section including a plurality of opposed first clamping formations, and the intermediate clamp section including a plurality of opposed inwardly offset second clamping formations, for clamping the blank in a clamping position;

the intermediate clamp section including at least a pair of clamp modules on opposite sides of the travel path, each clamp module having an inner peripheral region with at least one projection extending inwardly therefrom and transverse to the travel path, wherein at least one of the plurality of opposed inwardly offset second clamping formations is formed on each projection, and is inwardly offset relative to the corresponding clamping nodule, in order to clamp the metal blank in the clamping position;

the second die section having cut-out regions transverse to the travel path, each cut-out region for receiving a corresponding projection;

the first die section being movable relative to the second die section from the retracted position to the clamping position before reaching the stamping position, so as to clamp the metal blank between the first clamping formations and the corresponding inwardly offset second clamping formations;

the intermediate clamp section being operable for travel with the first die section, relative to the second die section, to the stamping position so as to nest with the second die section with each projection resident in a corresponding cut-out region.

2. A device as defined in claim 1, the second surface portion having at least one support portion slidably extending therethrough for supporting the metal blank prior to clamping.

3. A device as defined in claim 2, the at least one supporting portion being movable relative to the second die section, wherein the second die section is operable for travel to the stamping position so as to disengage the metal blank and the supporting portion.

4. A device as defined in claim 1, the projections being oriented so as not to extend into the second work piece-forming region.

5. A device as defined in claim 4, the clamping formations being shaped to form retention beads on a peripheral scrap region in the blank which is spaced from the work piece.

6. A device as defined in claim 1, the projections being oriented so as to extend into the second work piece-forming region.

7. A device as defined in claim 6, the clamping formations being continuous with the work piece-forming regions, so as to form one or more clamping retention beads inside a trim line, thereby to remain in a final stamped part.

8. A device as defined in claim 1, the first die section and the intermediate clamp section further comprising at least respective third and fourth clamping formations for clamping blanks of different lengths.

9. A device as defined in claim 8, the intermediate clamp section further comprising a blank shifting member operable for aligning the blank for clamping with the first and second clamping formations and/or the third and fourth clamping formations.

10. A device as defined in claim 9, the blank shifting member including an actuated member for aligning and maintaining the blank in a desired clamping position.

11. A device as defined in claim 1, the intermediate clamp section including a trim line cutter.

12. A device as defined in claim 10, the actuated member including a hydraulic cylinder with a piston carrying an effector operatively coupled to the intermediate clamp section; the piston operable for aligning and maintaining the blank in the desired clamping position.

13. A method for reducing the required length of a blank to produce a stamped part therefrom, the method comprising the steps of:

a) providing a first die section, a second die section, and an intermediate die section, the first die section including a pair of opposed first section boundaries;

b) providing a metal blank with a reduced length in relation to a corresponding length of the first die section, and with opposed edges inwardly spaced from the opposed first die section boundaries;

c) placing the metal blank between the first and second die sections with the first and second die sections in a retracted position;

the first and second die sections being operable for movement along a travel path relative each other between the retracted position and a stamping position;

the first and second die sections including complementary first and second surface portions with respective first and second work piece-forming regions located thereon, the first work-piece forming region being located in a central inner region of the first die section and spaced from the opposed first die section boundaries;

the first and second work piece-forming regions being arranged for shaping a work piece from the metal blank;

the intermediate clamp section including at least a pair of clamp modules on opposite sides of the travel path, each clamp module including an inner peripheral region with at least one projection extending inwardly therefrom and transverse to the travel path, the second die section having cut-out regions transverse to the travel path, each cut-out region for receiving a corresponding projection;

the first die section including a plurality of opposed first clamping formations, and the intermediate clamp section including a plurality of opposed inwardly offset second clamping formations, wherein at least one of the inwardly offset second clamping formations is located on each projection and inwardly offset relative to the corresponding clamp module, for clamping the blank;

d) aligning the metal blank with the first clamping formations and the inwardly offset second clamping formations;

e) causing the first die section to travel relative to the intermediate clamp section to engage and clamp the metal blank therebetween at a clamping position; and thereafter f) causing the first die section and the intermediate clamp section to travel relative to the second die section, with each projection being received in a corresponding cut-out region on the second work piece-forming region, so as to communicate with the first work piece forming region in a stamping position, so as to form a stamped part;

g) causing the first and second die sections and the intermediate clamp section to move to a retracted position; and h) removing the stamped part from between the first and second die sections.

14. A method as defined in claim 13, further comprising utilizing respective third and fourth clamping formations on the first die section and the intermediate clamp section at least for clamping blanks of different lengths.

15. A method of claim 14, further comprising utilizing a blank shifter for aligning the blank in step (b) for clamping with the first and second clamping formation and/or the third or fourth clamping formations.

16. A method as defined in claim 15, wherein the blank is of a first length for clamping with the first and second clamping formations and/or the third and fourth clamping formations.

17. A method as defined in claim 15 wherein the blank is of a second length for clamping with the third and fourth clamping formations.

18. A method as defined in claim 13, further comprising cutting the stamped part along a trim line so as to sever a peripheral scrap region from the final part.

* * * * *